US010635025B2

(12) United States Patent
Butler et al.

(10) Patent No.: US 10,635,025 B2
(45) Date of Patent: Apr. 28, 2020

(54) TRANSMISSION FOR AN LEP DEVELOPER UNIT

(71) Applicant: HP Indigo B.V., Amstelveen (NL)

(72) Inventors: Blair A Butler, San Diego, CA (US); Andre Garcia, San Diego, CA (US); James Kiang, San Diego, CA (US); David Sabo, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 74 days.

(21) Appl. No.: 15/749,022

(22) PCT Filed: Jan. 8, 2016

(86) PCT No.: PCT/US2016/012711

§ 371 (c)(1),
(2) Date: Jan. 30, 2018

(87) PCT Pub. No.: WO2017/119905

PCT Pub. Date: Jul. 13, 2017

(65) Prior Publication Data

US 2018/0329336 A1 Nov. 15, 2018

(51) Int. Cl.
*G03G 15/11* (2006.01)

(52) U.S. Cl.
CPC ..... *G03G 15/11* (2013.01)

(58) Field of Classification Search
None
See application file for complete search history.

(56) References Cited

U.S. PATENT DOCUMENTS

| | | | | |
|---|---|---|---|---|
| 5,126,800 | A | 6/1992 | Shishido et al. | |
| 5,331,378 | A | 7/1994 | Baker et al. | |
| 5,950,052 | A | 9/1999 | Nomura et al. | |
| 6,067,434 | A | 5/2000 | Takagi et al. | |
| 6,359,638 | B1 | 3/2002 | Saeki | |
| 6,876,371 | B2 | 4/2005 | Suzuki et al. | |
| 6,987,941 | B2 | 1/2006 | Takeuchi et al. | |
| 7,877,046 | B2 | 1/2011 | Nelson et al. | |
| 9,052,635 | B2 | 6/2015 | Ishii | |
| 2007/0122180 | A1* | 5/2007 | Miyaji | G03G 15/0225 399/100 |
| 2009/0097883 | A1 | 4/2009 | Guzman et al. | |
| 2010/0215405 | A1 | 8/2010 | Patton et al. | |
| 2011/0249989 | A1 | 10/2011 | Levintant et al. | |

FOREIGN PATENT DOCUMENTS

DE 102014108224 11/2015

* cited by examiner

*Primary Examiner* — David M. Gray
*Assistant Examiner* — Geoffrey T Evans
(74) *Attorney, Agent, or Firm* — Steven R. Ormiston

(57) ABSTRACT

A transmission for a developer unit that includes a developer roller to apply LEP ink to a photoconductor, a cleaner roller to clean the developer roller, and a squeegee roller to squeegee ink on the developer roller. In one example, the transmission includes a mechanical drive train to, with the cleaner roller, simultaneously drive the developer roller at a first surface speed and the squeegee roller at a second surface speed slower than the first surface speed.

14 Claims, 9 Drawing Sheets

TRANSMISSION FOR AN LEP DEVELOPER UNIT

BACKGROUND

Liquid electro-photographic (LEP) printing uses a special kind of ink to form images on paper and other print substrates. LEP ink usually includes charged polymer particles dispersed in a carrier liquid. The polymer particles are sometimes referred to as toner particles and, accordingly, LEP ink is sometimes called liquid toner. LEP ink may also include a charge control agent, sometimes called a "charge director", to help control the magnitude and polarity of charge on the particles. An LEP printing process involves placing an electrostatic pattern of the desired printed image on a photoconductor and developing the image by applying a thin layer of LEP ink to the charged photoconductor. Charged toner particles in the ink adhere to the pattern of the desired image on the photoconductor. The ink image is transferred from the photoconductor to a print substrate, for example through a heated intermediate transfer member, evaporating much of the carrier liquid to dry the ink film, and then to the print substrate as it passes through a nip between the intermediate transfer member and a pressure roller.

DRAWINGS

Gear teeth are omitted in the figures to more simply illustrate the gear trains. The same part numbers designate the same or similar parts throughout the figures. The figures are not necessarily to scale.

DESCRIPTION

A new transmission has been developed to drive the squeegee roller in a developer unit for an LEP printer. In one example, the transmission slows the rotational speed and thus the corresponding surface speed of the squeegee roller to help reduce the risk of flow streaks that can occur with some LEP inks, while still driving the squeegee, developer and sponge rollers off the cleaner roller. In one example, the transmission includes a mechanical drive train that, with the cleaner roller, simultaneously drives the developer roller at a first rotational speed (corresponding to the desired surface speed) and the squeegee roller at a second rotational speed (corresponding to the desired, slower surface speed), while maintaining the same roller positions within the same space occupied by a prior transmission. Thus, in this example, the new transmission may be implemented without additional electronics and with few if any changes to the developer unit housing and the printer chassis. In one example, the mechanical drive train includes seven gears (and no belt) to transmit power from the cleaner roller (driven by the motor) to the sponge and squeegee rollers—three roller mounted gears (cleaner, sponge and squeegee rollers) and four idler gears.

These and other examples described below and shown in the figures illustrate but do not limit the scope of the patent, which is defined in the Claims following this Description.

As used in this document, "LEP ink" means a liquid that is suitable for electro-photographic printing and "liquid" means a fluid not composed primarily of a gas or gases.

Figure 1:
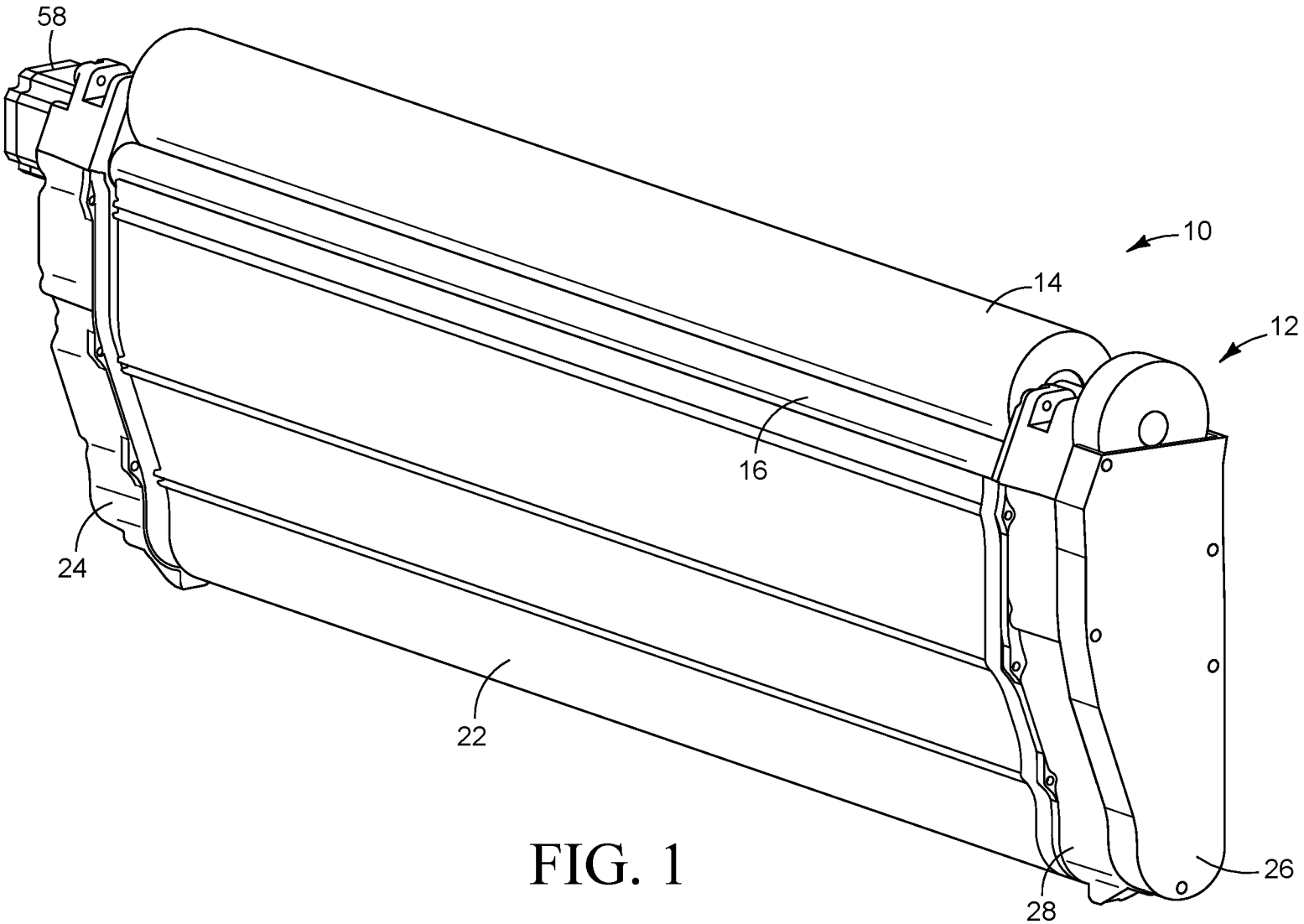
FIGS. 1-3 illustrate a developer unit such as might be used in an LEP printer, implementing one example of a transmission to drive a squeegee roller. One end cap and the gear case are removed in FIGS. 2 and 3, and the gears exploded away from the rollers in FIG. 3, to more clearly show the example transmission.
Figure 2:
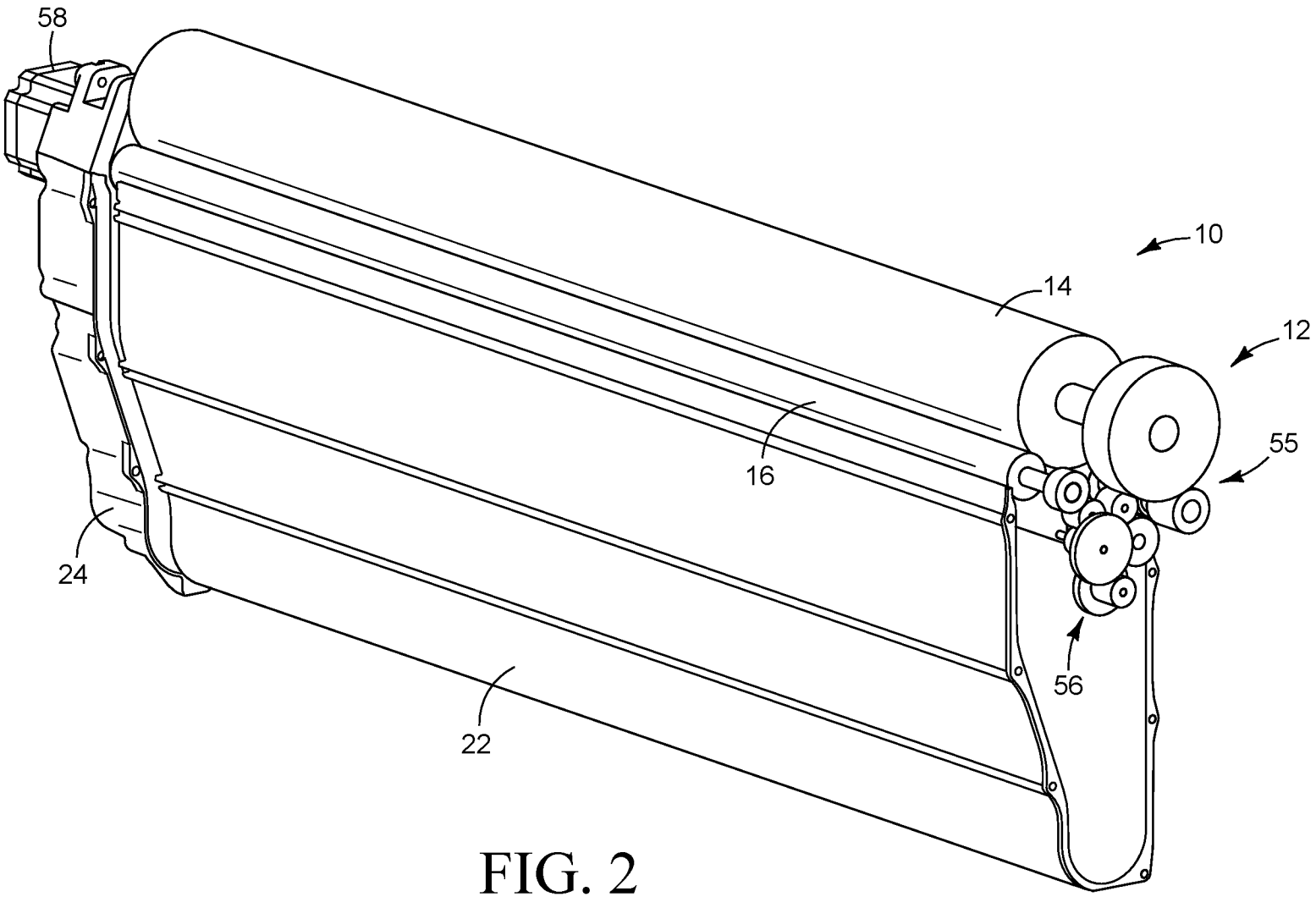
Figure 3:
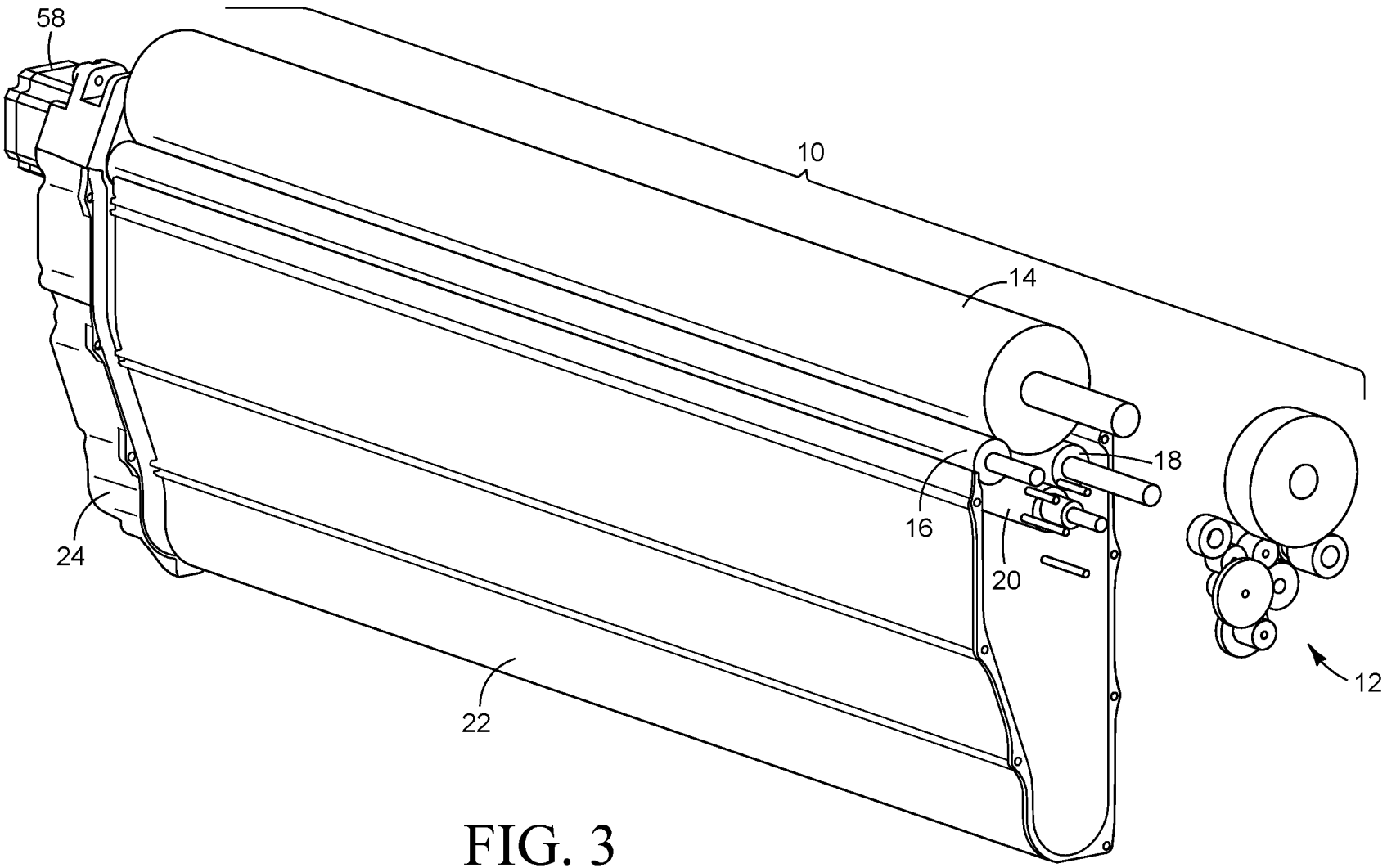
Figure 4:
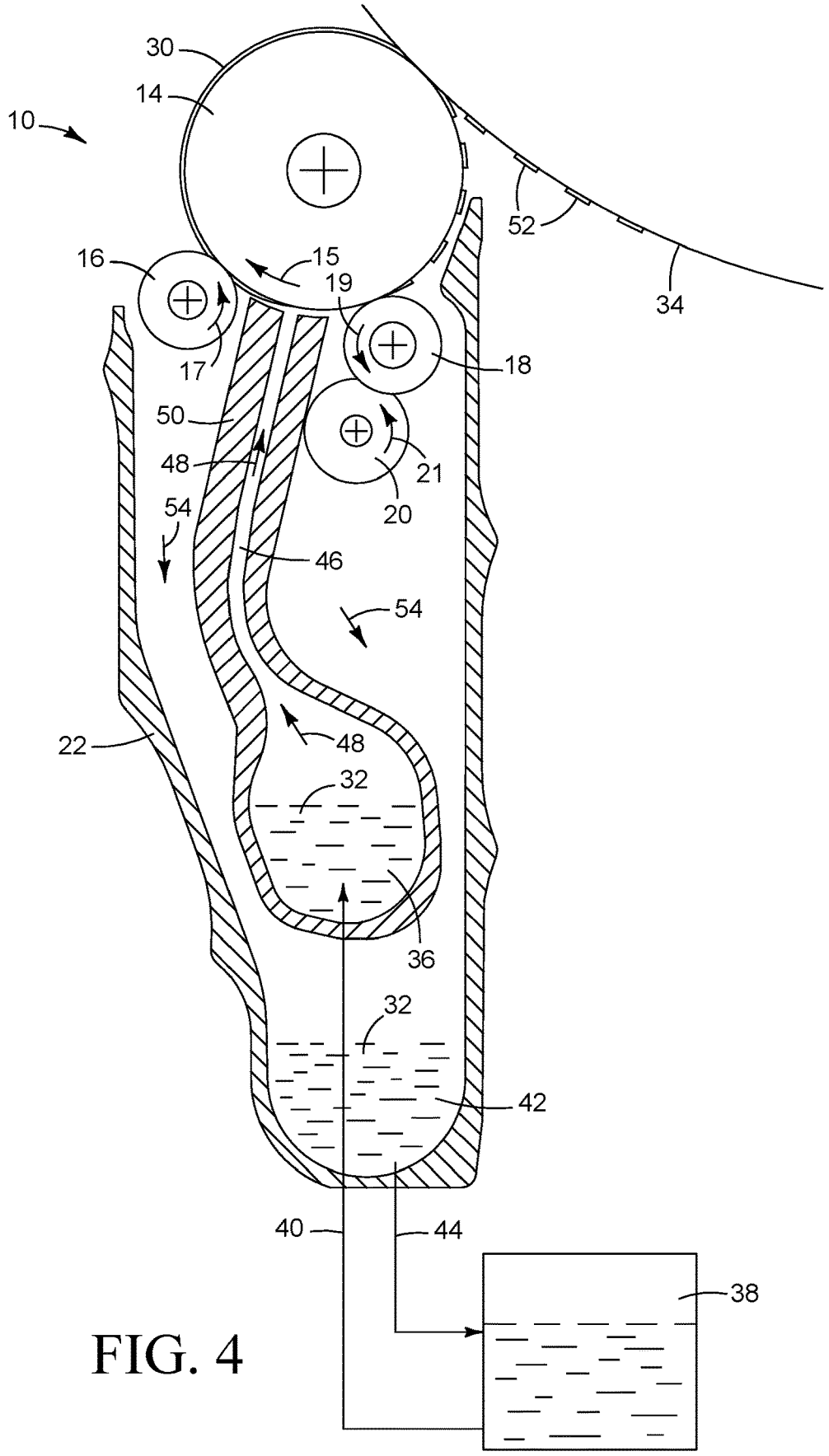
FIG. 4 is an end view of the developer unit of FIGS. 1-3 without the transmission, illustrating one example for the configuration of the developer, squeegee, cleaner, and sponge rollers.

FIGS. 1-3 illustrate a developer unit 10 such as might be used in an LEP printer, implementing one example of a new "slow squeegee" transmission 12. One end cap and the gear case are removed in FIGS. 2 and 3, and the gears exploded away from the rollers in FIG. 3, to more clearly show transmission 12. FIG. 4 is an end view of developer unit 10 without transmission 12, illustrating one example for the configuration of the developer, squeegee, cleaner, and sponge rollers 14, 16, 18, and 20, respectively. A developer unit 10 for an LEP printer is commonly referred to as a "binary ink developer" or a "BID." An LEP printer may include multiple BIDs, one for each color ink for example.

Referring to FIGS. 1-4, developer unit 10 includes a housing 22 housing developer roller 14, squeegee roller 16, cleaner roller 18, and sponge roller 20. In the example shown, developer unit 10 is configured as a removable/replaceable unit, with end caps 24, 26 and a gear casing 28. Developer roller 14 is exposed outside housing 22 to present a film 30 of LEP ink 32 to a photoconductor 34 (FIG. 4). LEP ink 32 may be pumped to a local supply chamber 36 in developer unit 10 from an external reservoir 38 through an inlet 40, as shown diagrammatically in FIG. 4. Also, excess ink 32 may be reclaimed and collected in a local return chamber 42 and returned to reservoir 38 through an outlet 46.

Referring specifically to FIG. 4, in operation, according to one example, supply chamber 36 is pressurized to force ink 32 up through a channel 46 to the electrically charged developer roller 14, as indicated by flow arrows 48. A thin layer of ink 32 is applied electrically to the surface of a rotating developer roller 14 along an electrode 50. A large voltage difference between developer roller 14 and electrode 50 causes charged particles in the LEP ink to adhere to roller 14. Squeegee roller 16 is also charged to a higher voltage than developer roller 14. Squeegee roller 16 rotates along developer roller 14 to squeegee excess carrier liquid from ink on roller 14 while charged particles in the ink continue to adhere developer roller 14. In the example shown, developer roller 14 is rotated clockwise (arrow 15) and squeegee roller 16 is rotated counterclockwise (arrow 17) so that the surfaces move in the same direction at the interface between rollers 14, 16.

The now more concentrated ink film 30 on developer roller 14 is presented to photoconductor 34 where some of the ink is transferred in the pattern of a latent electrostatic image on the photoconductor, as the desired ink image 52. A charged cleaner roller 18 rotates along developer roller 14 to electrically remove residual ink from roller 14. In the example shown, cleaner roller 18 is rotated counterclockwise (arrow 19) so that the surfaces move in the same direction at the interface between rollers 14, 18. Cleaner roller 18 is scrubbed with a so-called "sponge" roller 20 that is rotated against cleaner roller 18. In the example shown, sponge roller 20 is rotated counterclockwise (arrow 21) so that the surfaces move in opposite directions at the interface between rollers 18, 20. Some of the ink residue may be absorbed into sponge roller 20 and some may fall away. Ink is removed from sponge roller 20 through contact with the chamber wall and/or with a squeezer roller (not shown). Excess carrier liquid and ink drains to return chamber 42, as indicated by flow arrows 54 where it can be recycled to reservoir 38.

Figure 5:
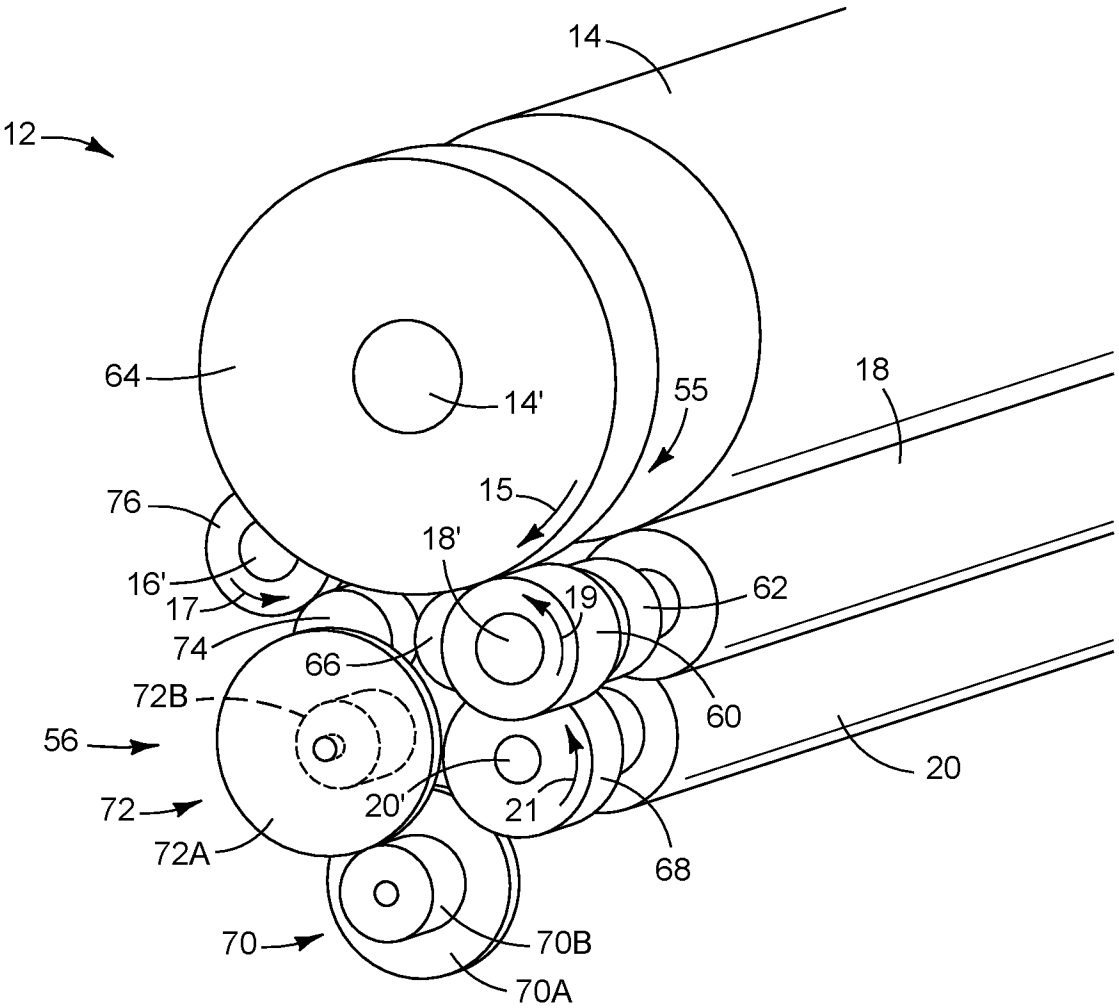
FIGS. 5 and 6 are close-up views of the example transmission shown in FIGS. 1-3.
Figure 6:
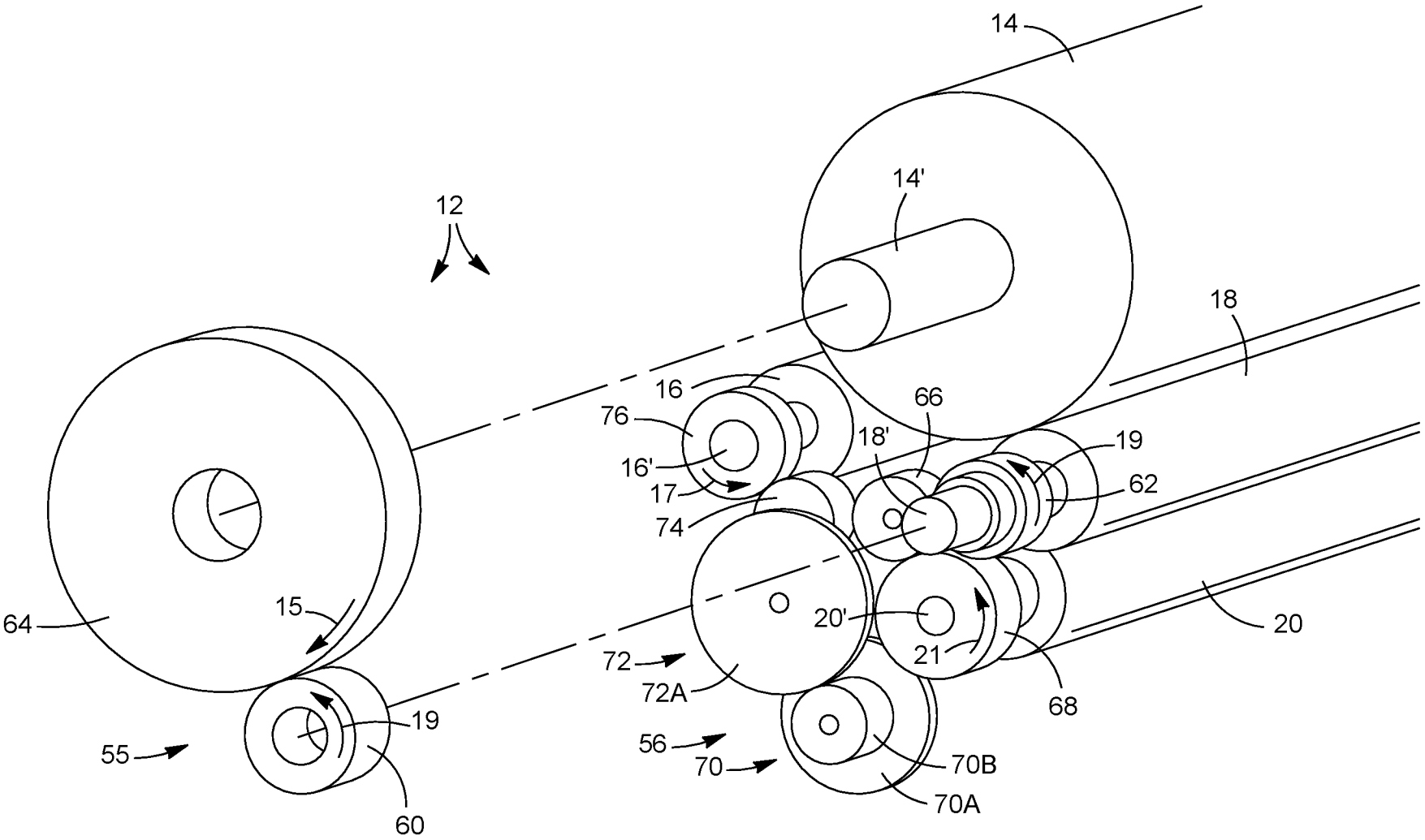
Figure 7:
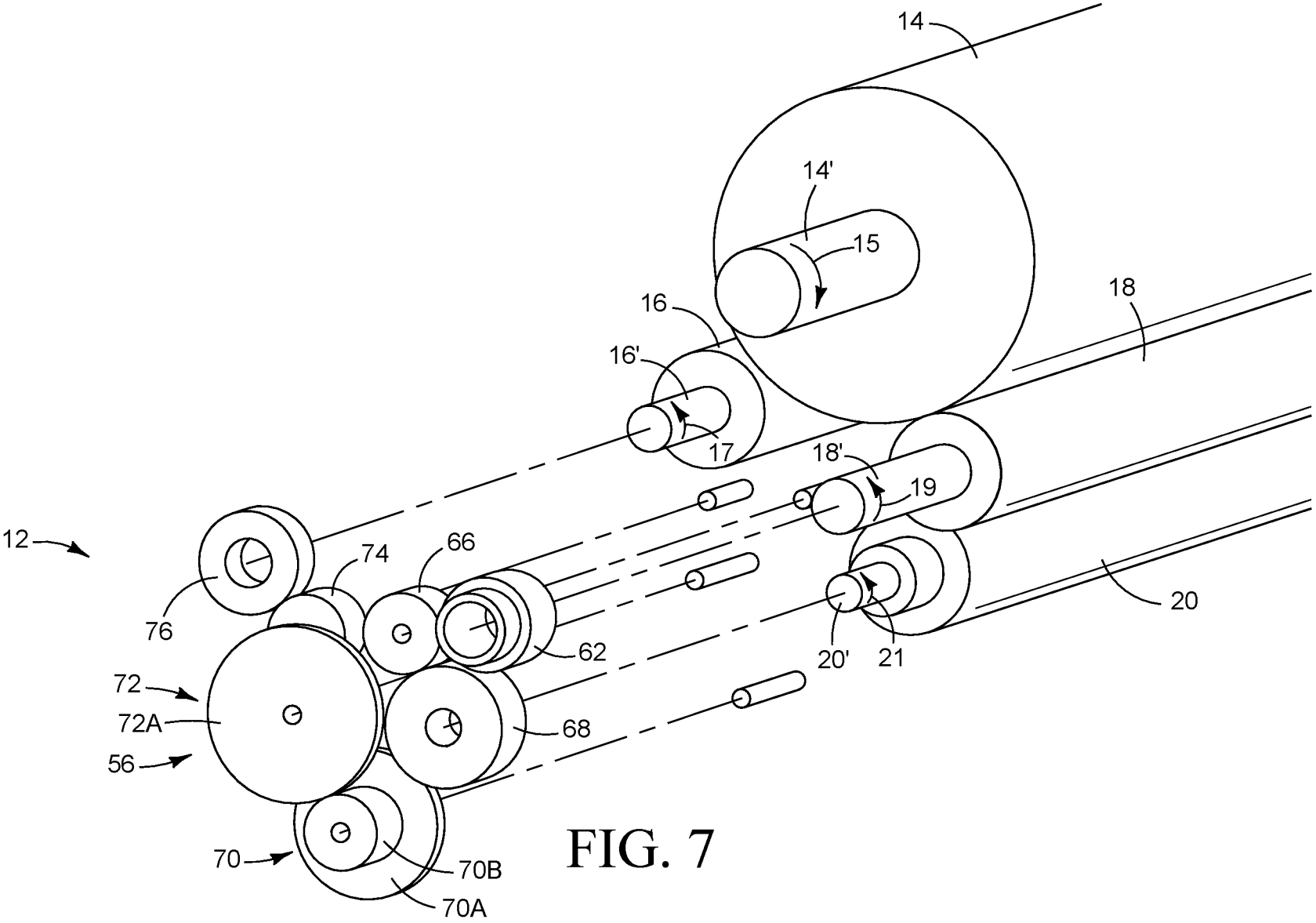
FIG. 7 is a close-up view illustrating the drive train for the squeegee roller in the example transmission shown in FIGS. 5 and 6.
Figure 8:
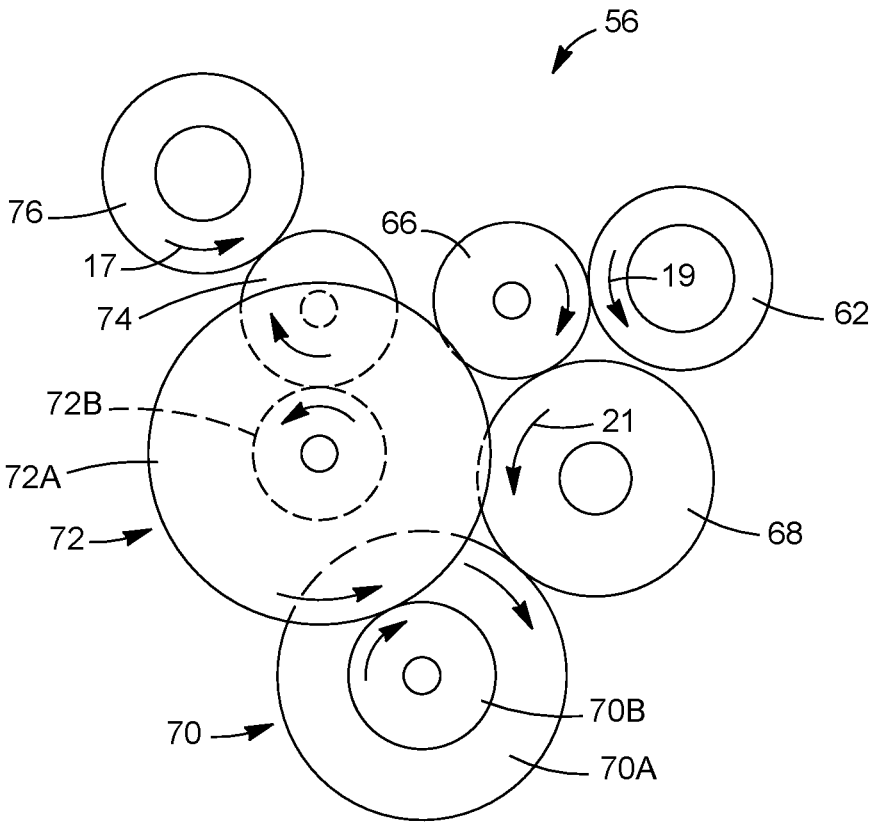
FIG. 8 is an end view of the drive train for the squeegee roller in the example transmission shown in FIGS. 5-7.

FIGS. 5 and 6 are close-up views illustrating transmission 10 from FIGS. 1-3, including a gear train 55 to drive developer roller 14 and a gear train 56 to drive squeegee roller 16. The gears in developer roller gear train 55 are exploded away from the rollers in FIG. 6. FIGS. 7 and 8 are close-up views illustrating squeegee roller gear train 56, with the gears exploded away from the rollers in FIG. 7 and the rollers omitted in FIG. 8.

Referring first to FIGS. 5 and 6, each roller 14, 16, 18, and 20 is mounted on or otherwise operatively connected to or integrated with a shaft 14', 16', 18', and 20', respectively. Each roller 14-20 is rotated by turning the corresponding shaft 14'-20'. Cleaner roller 18 is driven directly by a motor 58 (FIGS. 1-3) operatively connected to shaft 18'. Rollers 14, 16, and 20 are driven by motor 58 indirectly through cleaner roller 18. In the example shown, gear train 55 for developer roller 14 includes a first cleaner gear 60 on shaft 18' that engages a developer gear 64 on shaft 14' to rotate developer roller 14, at the urging of cleaner roller 18. In this example, shaft 18' (and thus gear 60 and cleaner roller 18) is rotated counterclockwise (arrow 19) and, accordingly, gear 64 (and thus shaft 14' and developer roller 14) is rotated clockwise (arrow 15).

Referring now also to FIGS. 7 and 8, in the example shown, gear train 56 for squeegee roller 16 includes: a second cleaner gear 62 on cleaner shaft 18'; a first idler gear 66; a sponge gear 68 on sponge shaft 20'; a compound second idler gear 70 (with larger and smaller gears 70A, 70B); a compound third idler gear 72 (with larger and smaller gears 72A, 72B); a fourth idler gear 74; and a squeegee gear 76 on squeegee shaft 16'. Second cleaner gear 62 engages first idler gear 66 which engages sponge gear 68 on shaft 20' to rotate sponge roller 20, at the urging of cleaner roller 18. Sponge gear 68 engages larger gear 70A on compound second idler gear 70, smaller gear 70B on compound second idler gear 70 engages larger gear 72A on compound third idler gear 72, smaller gear 72B on compound third idler gear 72 engages fourth idler gear 74 which engages squeegee gear 76, to rotate squeegee roller 16 at the urging of cleaner roller 18.

It may be desirable in LEP printing to match the surface speed of the cleaner roller 18 to the surface speed of the developer roller 14 to facilitate electrostatic cleaning. If the developer roller is significantly larger than the cleaner roller, then the developer roller gear train 55 may provide a speed reduction from cleaner roller 18 to developer roller 14. Also, a shorter gear train 55 for the developer roller may help more precisely control the surface speed of developer roller 14 with respect to photoconductor 24 (FIG. 4). Thus, in the example shown, developer gear 64 is driven directly by first cleaner gear 60 (i.e., with no intermediate gears) through a gear train 55 that provides rotational speed reduction, for example, with a smaller first cleaner gear 60 and a proportionately larger developer gear 64.

As noted above, unequal surface speeds between developer roller 14 and squeegee roller 16 may be desirable to help reduce streaking. While the desired surface speed reduction for squeegee roller 16 may vary depending on the LEP ink and the size and other characteristics of the rollers in developer unit 10, a squeegee roller surface speed in range of 10% to 40% of the surface speed of the developer roller has been shown to significantly reduce flow streaks in developer units for some HP Indigo® LEP printers. For a developer unit 10 in which developer roller 14 is about 3.0 times larger than squeegee roller 16 and cleaner roller 18, the rotational speed reduction through gear train 55 is about 3:1 to match the surface speeds of developer roller 14 and cleaner roller 18. For a developer unit 10 in which squeegee roller 16 and cleaner roller 18 are about the same diameter, for example, the corresponding rotational speed reduction from cleaner roller 18 to squeegee roller 16 through gear train 56 is in the range of about 10:1 to 10:4. Thus, in this example for rollers 14, 16, 18 and gear trains 55 and 56, squeegee roller 16 will be rotated at about 0.3 to 1.2 times the rotational speed of developer roller 14 to deliver a squeegee roller surface speed in range of 10% to 40% of the surface speed of the developer roller.

In one specific implementation, a rotational speed reduction of about 10:1 for squeegee roller 16 has been shown to reduce streaking where cleaner roller 18 is driven at about 1700 rpm, gear train 55 is configured to rotate developer roller 14 at about 598 rpm, and gear train 56 is configured to rotate squeegee roller 16 at about 170 rpm. In one example to achieve an overall rotational speed reduction of about 10:1, gear train 56 is configured to achieve a speed reduction of about 0 from cleaner roller 18 to first idler 66 (e.g., 1700 rpm to 1700 rpm), a speed reduction of about 1.3:1 from first idler 66 to sponge roller 20 (e.g., 1700 rpm to 1261 rpm), a speed reduction of about 1.4:1 from sponge roller 20 to second idler 70 (e.g., 1261 rpm to 931 rpm), a speed reduction of about 3.3:1 from second idler 70 to third idler 72 (e.g., 931 rpm to 286 rpm), a further speed reduction of about 1.4:1 from third idler 72 to fourth idler 74 (e.g., 286 rpm to 199 rpm), and a further speed reduction of about 1.1:1 from fourth idler 74 to squeegee roller 16 (e.g., 199 rpm to 176 rpm).

In the example shown in the figures, transmission 12 includes a mechanical drive train to drive the squeegee roller with the cleaner roller but at a substantially slower rotational speed, while maintaining the same roller positions and within the same space occupied by an existing transmission (in which there is no squeegee speed reduction). Thus, in this example, transmission 12 may be implemented without additional electronics and with few if any changes to the existing developer unit housing and corresponding printer chassis. Compound idlers 70, 72 help conserve space in gear train 56 by achieving a substantial speed reduction with overlapping gears. Also, the use of identical first and fourth idler gears 66, 74 help reduce cost and preserve the same roller configuration as in the existing developer unit, thus enabling "backward" compatibility (i.e., retrofitting "old" printers with new developer units).

Figure 9:
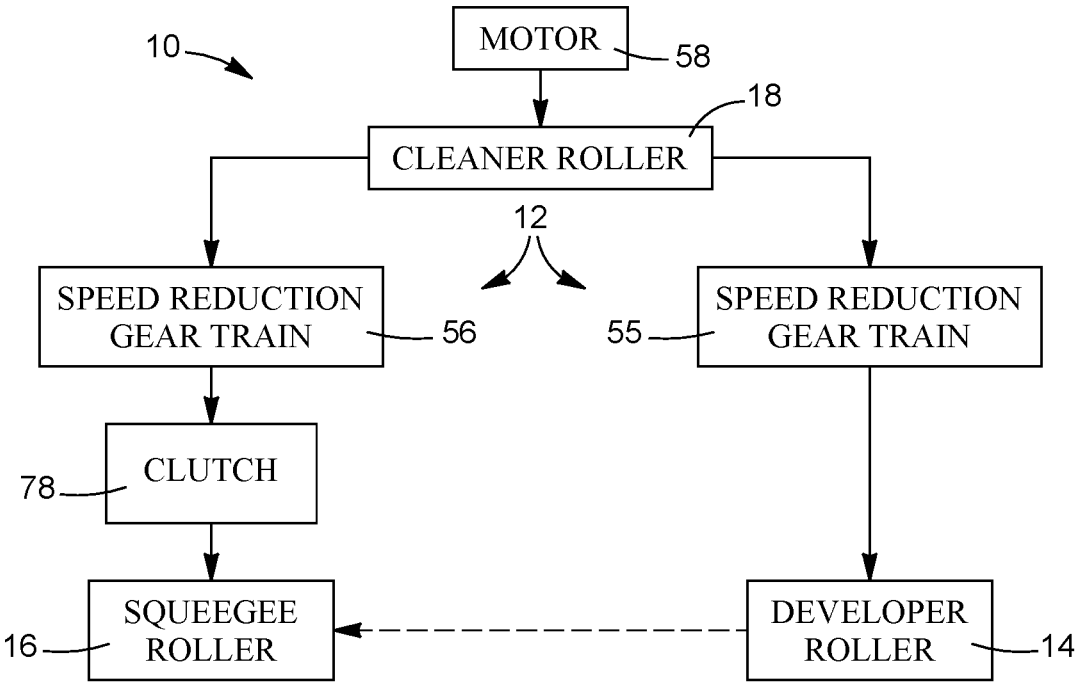
FIG. 9 is a block diagram illustrating a developer unit such as might be used in an LEP printer, implementing one example of a transmission to drive a squeegee roller.

FIG. 9 is a block diagram illustrating a developer unit 10 such as might be used in an LEP printer, implementing one example of a transmission 12 to drive a squeegee roller 16. Referring to FIG. 9, a motor 58 in unit 10 drives cleaner roller 18. Transmission 12 includes a speed reduction gear train 55 to drive developer roller 14 at a first rotational speed less than cleaner roller 18. Transmission 12 also includes speed reduction gear train 56 to drive squeegee roller 16 at a second rotational speed less than cleaner roller 18. In one example, the second rotational speed (of the squeegee roller) is in the range of 0.3 to 1.2 times the first rotational speed (of the developer roller).

Also, in the example shown in FIG. 9, transmission 12 includes a one-way clutch 78 that allows squeegee roller 16 to rotate at the same surface speed as developer roller 14 when there is no ink between the rollers, and thus prevent damage to both rollers. When ink is present, lower friction between rollers 14, 16 allows the faster moving surface of developer roller 14 and the slower moving surface of squeegee roller 16 to slip past one another. When ink is not present, higher friction between the rollers causes the faster moving surface of developer roller 14 to drive the slower moving surface of squeegee roller 16 to move faster. Clutch 78 automatically disengages squeegee roller 16 from squeegee gear 76 during periods of higher friction to allow the surface of the squeegee roller to accelerate to match the speed of the surface of the developer roller.

Figure 10:
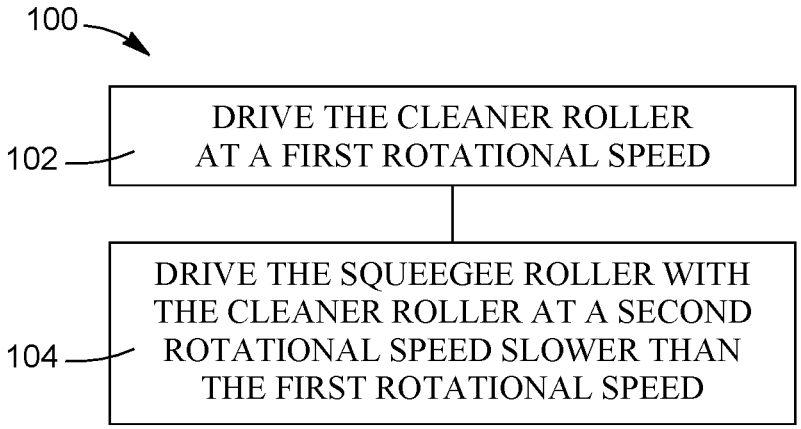
FIG. 10 is a flow diagram illustrating one example of a process for driving a squeegee roller in a developer unit for an LEP printer.

FIG. 10 is a flow diagram illustrating one example of a process 100 for driving a squeegee roller in a developer unit for an LEP printer. Referring to FIG. 10, process 100 includes driving a cleaner roller 18 at a first rotational speed (block 102), for example with a motor 58 shown in FIGS. 1-3, and driving a squeegee roller 16 with the cleaner roller 18 at a second rotational speed slower than the first rotational speed, for example through a gear train 56 shown in FIGS. 5-8. In one example, process 100 also include driving a developer roller 14 with cleaner roller 18 at a third rotational speed slower than the first rotational speed, for example through a gear train 55 shown in FIGS. 5 and 6. In one example, process 100 also includes clutching squeegee roller 16 to cleaner roller 18 when there is ink between developer roller 14 and squeegee roller 16 and unclutching squeegee roller 16 from cleaner roller 18 when there is not ink between developer roller 14 and squeegee roller 16, for example through a one-way clutch 78 shown in FIG. 9.

"A", "an", and "the" used in the claims means one or more. For example, "a developer roller" means one or more developer rollers and "the developer roller" means the one or more developer rollers.

The examples shown in the figures and described above illustrate but do not limit the patent, which is defined in the following Claims.

The invention claimed is:

1. A transmission for a developer unit that includes a developer roller to apply LEP ink to a photoconductor, a cleaner roller to clean the developer roller, and a squeegee roller to squeegee ink on the developer roller, the transmission comprising:

a mechanical drive train to, with the cleaner roller, simultaneously drive the developer roller at a first surface speed and the squeegee roller at a second surface speed slower than the first surface speed; and a one-way clutch to disengage the squeegee roller from a squeegee gear to allow the squeegee roller to rotate at a same surface speed as the developer roller when there is no ink between the squeegee roller and the developer roller.

2. The transmission of claim 1, where the mechanical drive train includes a first gear train to drive the developer roller at the first surface speed with the cleaner roller and a second gear train to drive the squeegee roller at the second speed with the cleaner roller, and where the second surface speed is 10% to 40% of the first surface speed.

3. The transmission of claim 2, where the first gear train is to drive the developer roller at a first rotational speed and the second gear train is to drive the squeegee roller at a second rotational speed 0.3 to 1.2 times the first rotational speed.

4. The transmission of claim 3, where the first gear train and the second gear train do not share any gears.

5. The transmission of claim 4, comprising a motor to drive the cleaner roller.

6. A developer unit for an LEP printer, comprising:

a developer roller to apply LEP ink to a photoconductor;

a cleaner roller to clean the developer roller;

a sponge roller to sponge the cleaner roller;

a squeegee roller to squeegee ink on the developer roller; and a transmission including:

a first gear mounted to the cleaner roller;

a second gear mounted to the sponge roller;

a third gear mounted to the squeegee roller;

multiple idler gears connected among the first, second, and third gears to drive the sponge roller and the squeegee roller simultaneously at the urging of the cleaner roller; and a one-way clutch to disengage the squeegee roller from the third gear to allow the squeegee roller to rotate at a same surface speed as the developer roller when there is no ink between the squeegee roller and the developer roller.

7. The developer unit of claim 6, where the gears are to drive the squeegee roller at a rotational speed reduction of 10:1 to 10:4 with respect to the cleaner roller.

8. The developer unit of claim 6, where the idler gears include:

a fourth, idler gear connected between the first gear and the second gear, to rotate the second gear at the urging of the first gear;

a fifth, compound idler gear having a smaller gear and a larger gear;

a sixth, compound idler gear having a smaller gear and a larger gear; and a seventh, idler gear; and where:

the second gear is connected to the smaller gear on the fifth, compound idler gear, to rotate the fifth gear at the urging of the second gear;

the larger gear on the fifth, compound idler gear is connected to the smaller gear on the sixth, compound idler gear, to rotate the sixth gear at the urging of the fifth gear; and the seventh, idler gear is connected between the larger gear on the sixth, compound idler gear and the third gear, to rotate the third gear at the urging of the sixth gear.

9. The developer unit of claim 6, comprising a motor to drive the cleaner roller at a first rotational speed and where the gears are to drive the squeegee roller at a second rotational speed slower than the first rotational speed.

10. The developer unit of claim 9, where the ratio of the first rotational speed to the second rotational speed is 10:1 to 10:4.

11. In a developer unit that includes a developer roller to apply LEP ink to a photoconductor, a cleaner roller to clean the developer roller, and a squeegee roller to squeegee ink on the developer roller, a process comprising:

driving the cleaner roller at a first rotational speed; and driving the squeegee roller with the cleaner roller at a second rotational speed slower than the first rotational speed;

clutching the squeegee roller to the cleaner roller when there is ink between the developer roller and the squeegee roller; and unclutching the squeegee roller from the cleaner roller when there is not ink between the developer roller and the squeegee roller.

12. The process of claim 11, where the developer unit includes a sponge roller to sponge the cleaner roller and driving the squeegee roller comprises driving the squeegee roller with the cleaner roller through the sponge roller at a second rotational speed slower than the first rotational speed.

13. The process of claim 12, comprising driving the sponge roller with the cleaner roller at a fourth rotational speed equal to the first rotational speed.

14. The process of claim 11, comprising driving the developer roller with the cleaner roller at a third rotational speed slower than the first rotational speed.

* * * * *